US009101219B2

(12) United States Patent
Smith

(10) Patent No.: US 9,101,219 B2
(45) Date of Patent: Aug. 11, 2015

(54) LOUNGE CHAIR HAVING ADJUSTABLE ARMRESTS

(71) Applicant: Patricia J. Smith, Thorne Bay, AK (US)

(72) Inventor: Patricia J. Smith, Thorne Bay, AK (US)

( * ) Notice: Subject to any disclaimer, the term of this patent is extended or adjusted under 35 U.S.C. 154(b) by 13 days.

(21) Appl. No.: 14/143,296

(22) Filed: Dec. 30, 2013

(65) Prior Publication Data

US 2014/0183909 A1 Jul. 3, 2014

Related U.S. Application Data

(60) Provisional application No. 61/748,224, filed on Jan. 2, 2013.

(51) Int. Cl.

| | |
|---|---|
| ***A47C 4/28*** | (2006.01) |
| ***A47C 4/30*** | (2006.01) |
| ***A47C 7/54*** | (2006.01) |
| ***A47C 1/14*** | (2006.01) |
| ***A47C 20/02*** | (2006.01) |
| ***A47C 1/03*** | (2006.01) |
| ***A47C 7/68*** | (2006.01) |
| ***A47C 17/70*** | (2006.01) |
| *A47C 4/46* | (2006.01) |

(52) U.S. Cl.

CPC ... *A47C 1/14* (2013.01); *A47C 1/03* (2013.01); *A47C 7/68* (2013.01); *A47C 17/70* (2013.01); *A47C 20/026* (2013.01); *A47C 1/143* (2013.01); *A47C 4/46* (2013.01)

(58) Field of Classification Search

CPC ..... A47C 20/026; A47C 1/30; A47C 4/46; A47C 1/143

USPC ..... 297/31, 45, 411.36, 411.38, 900, 297/411.31

See application file for complete search history.

(56) References Cited

U.S. PATENT DOCUMENTS

| | | | | |
|---|---|---|---|---|
| 3,206,249 | A * | 9/1965 | Gateley Frank R | 297/411.36 X |
| 4,277,102 | A * | 7/1981 | Aaras et al. | 297/411.36 |
| 4,441,756 | A | 4/1984 | Liou et al. | |
| 4,728,150 | A * | 3/1988 | Gaudreau, Jr. | 297/383 |
| 4,955,517 | A * | 9/1990 | Maresca | 297/411.36 X |
| 5,797,655 | A * | 8/1998 | Miles | 297/31 X |
| 5,908,221 | A * | 6/1999 | Neil | 297/411.36 |
| 6,109,685 | A | 8/2000 | Lindsey et al. | |
| 6,854,807 | B2 * | 2/2005 | D'Alessandro | 297/900 X |
| 7,021,717 | B2 | 4/2006 | Gaylord et al. | |
| 7,703,854 | B2 | 4/2010 | LaFreniere | |
| 7,832,804 | B2 | 11/2010 | LaFreniere | |
| 7,963,592 | B1 * | 6/2011 | Stanley | 297/31 |

* cited by examiner

*Primary Examiner* — Rodney B White

(74) *Attorney, Agent, or Firm* — Daniel Boudwin; Global Intellectual Property Agency LLC

(57) ABSTRACT

Described is an adjustable lounge chair having adjustable armrests. The lounge chair comprises an upper section, a middle section, a lower section, legs, support members, and armrests. The upper and lower sections are pivotally adjustable so that the user may configure the chair in a seated, reclined, or prone position. The support members are attached to the middle section near the upper section, and are attached on opposite sides of the middle section. Each support member has a joint at its upper end which is pivotally connected to an armrest such that the armrests can be rotated upwards or outward from the chair. Further, the support members have a means for adjusting the height of the armrests. Overall, the present invention discloses a lounge chair with armrests that are adjustable so as to provide support for the user's arms regardless of the configuration of the lounge chair.

10 Claims, 5 Drawing Sheets

LOUNGE CHAIR HAVING ADJUSTABLE ARMRESTS

CROSS REFERENCE TO RELATED APPLICATION

This application claims the benefit of U.S. Provisional Application No. 61/748,224, Jan. 2, 2013 entitled "Full-Range Lounger." The above identified patent application is herein incorporated by reference in its entirety to provide continuity of disclosure.

BACKGROUND OF THE INVENTION

1. Field of the Invention

The present invention relates to lounge chairs. More specifically, the present invention describes a tri-fold lounge chair with adjustable arms that can be raised or lowered, and that can be rotated into various positions.

Many people enjoy sunbathing and use lounge chairs while sitting or lying outside in the sun. Using a lounge chair provides sunbathers with more comfort than simply lying on the ground, and many lounge chairs provide the user with the ability to adjust the lounge chair into a variety of positions. While traditional lounge chairs allow the user to adjust the back rest or upper portion of the lounge chair, traditional lounge chairs do not allow users to adjust the armrests of the lounge chair. The inability to adjust the armrests is an inconvenience for sunbathers who may prefer to have the armrests configured in different positions. Further, the fixed armrests of traditional lounge chairs may also inhibit proper exposure of sun to the sunbather's arms. Traditional armrests may cast shadows on the sunbather's arms or otherwise obscure a portion of the user's body.

The present invention relates to an improved lounge chair having adjustable armrests. The lounge chair has an upper section, a middle section, and a lower section, and the upper and lower sections can be adjusted such that the chair can be configured in seated, reclined, or prone positions. Support members are attached to the middle section of the lounge chair, and further comprise a joint at the upper end of each support member. Each armrest is rotatable about the joint such that the armrests can be configured in a variety of positions. The support members further provide a means for adjusting the height of the armrests. When the lounge chair of the present invention is in use, a sunbather is able to adjust the armrests in any position desired regardless of the position of the lounge chair. Additional features that are present in some embodiments of the present invention include apertures in the upper section of the chair through which a user may place their face or arms, a head cushion, and cupholders located in the armrests.

2. Description of the Prior Art

Devices have been disclosed in the prior art that relate to lounge chairs. These include devices that have been patented and published in patent application publications. These devices generally relate to adjustable lounge chairs. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 7,832,804 to LaFreniere entitled "Lounge Chair with Adjustable Arm Rests." LaFreniere discloses a lounge chair having arm rests that are connected to the back rest of the chair by fixed securement devices. The arm rests are rotatable in a variety of directions by means of various types of joint, including for example a ball and socket joint. Further, LaFreniere discloses a lounge chair having a second set of armrests for use when the chair is in a reclined position. Thus, the device disclosed in LaFreniere has arms that can rotate in a variety of directions, but LaFreniere does not disclose a lounge chair having means for adjusting the height of the armrests. This is because the device in LaFreniere has armrests that rotate about fixed joints connected to the back rest of the lounge chair. In contrast, the present invention has armrests connected to support members attached to the middle section of the lounge chair by a means that allows the user to adjust the height of the armrests. Further, LaFreniere discloses a chair having a second set of armrests for use when the sunbather is in a reclined position, whereas the present invention utilizes a single set of armrests.

U.S. Pat. No. 7,703,854 to LaFreniere entitled "Lounge Chair with Adjustable Arm Rests" discloses an adjustable lounge chair having two sets of adjustable arms that can be rotated in various directions. The armrests are connected to the back support of the lounge chair and can be rotated about the connection therewith. A second set of armrests is placed closer to the top structural member of the lounge chair for the purpose of allowing a user lying in a prone position to rest their arms on the arm rests. In contrast to the present invention, LaFreniere discloses two sets of armrests and discloses the armrests as being attached to the back support of the chair. Further, the device in LaFreniere does not provide a means for adjusting the height of the armrests.

U.S. Pat. No. 6,109,685 to Lindsey entitled "Lounge Chair" discloses an adjustable lounge chair having adjustable arms. The arm support comprises a single component that includes armrests on opposite sides of the upper portion of the lounge chair. The arm support is rotatable about the upper portion of the lounge chair. The device disclosed by Lindsey does not allow the user to adjust each arm rest individually, and the arm support device can only be rotated in one direction and has a limited range of motion. Further, Lindsey does not disclose a device that allows a user to adjust the height of the armrests.

U.S. Pat. No. 4,441,756 to Liou et al. entitled "Lounge Chair with Improved Arm Rests" discloses a lounge chair having pivotally mounted armrests. The armrests are connected to the backrest and move in unison with movement of the backrest. Further, the armrests are connected to a support member that is pivotally connected with the seat of the chair. Liou discloses an improvement of this pivotal connection that strengthens the connection. Liou does not disclose a chair having armrests that are rotatable in various directions, and the armrests in Liou are coupled with the backrest. The armrests in Liou do not move independently, and the height of the armrests cannot be adjusted.

Finally, U.S. Pat. No. 7,021,717 to Gaylord entitled "Lounge Chair with Movable Arms" discloses a lounge chair having a seat, a back, legs, and armrests. The lounge chair has movable armrests that allow the user to orient the armrests in a raised position, or a lowered position adjacent to the side of the lounge chair. Further, preferred embodiments of the invention include a means of connecting the two armrests so that both armrests could be lowered by a single motion. While Gaylord discloses a lounge chair with armrests that are adjustable in height, Gaylord does not disclose a chair with armrests that can pivot or rotate in a variety of directions. Further, Gaylord discloses a device in which the armrests are connected so that both may be lowered in a single motion.

Gaylord also does not disclose a lounge chair having apertures in the upper portion through which a user can place their arms or face.

These prior art devices have several known drawbacks. Some lounge chairs in the prior art disclose armrests that can be rotated or pivoted in a variety of positions using a ball and socket joint. Some devices disclosed movable armrests, but the armrests could only be rotated to a limited extent. Other devices disclosed connecting the armrest to the upper portion of the lounge chair, and did not provide a means for adjusting the height of the armrests. Some devices disclosed in the prior art connected the two armrests of the lounge chair so that they could not move individually, but only as a unit.

In light of the devices in the prior art, it is submitted that the present invention is substantially divergent in design elements from the prior art, and consequently, it is clear that there is a need in the art for an improvement to existing lounge chairs with adjustable armrests. In this regard the instant invention substantially fulfills these needs.

SUMMARY OF THE INVENTION

In view of the foregoing disadvantages inherent in the known types of lounge chairs now present in the prior art, the present invention provides a new lounge chair with adjustable armrests wherein the same can be utilized for providing convenience for the user when sunbathing.

It is therefore an object of the present invention to provide a new and improved lounge chair device that has all of the advantages of the prior art and none of the disadvantages.

It is another object of the present invention to provide a user with a lounge chair that allows the user to selectively adjust the height and position of the armrests.

Another object of the present invention is to provide a simple and convenient way to adjust the armrests of a lounge chair while sitting or lying in the lounge chair.

Yet another object of the present invention is to provide the user with a lounge chair that has armrests which can be adjusted to allow the user to rest their arms while the user is lying face down on the lounge chair with their arms above or near their heads.

Another object of the present invention is to provide the user with a lounge chair having movable armrests that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
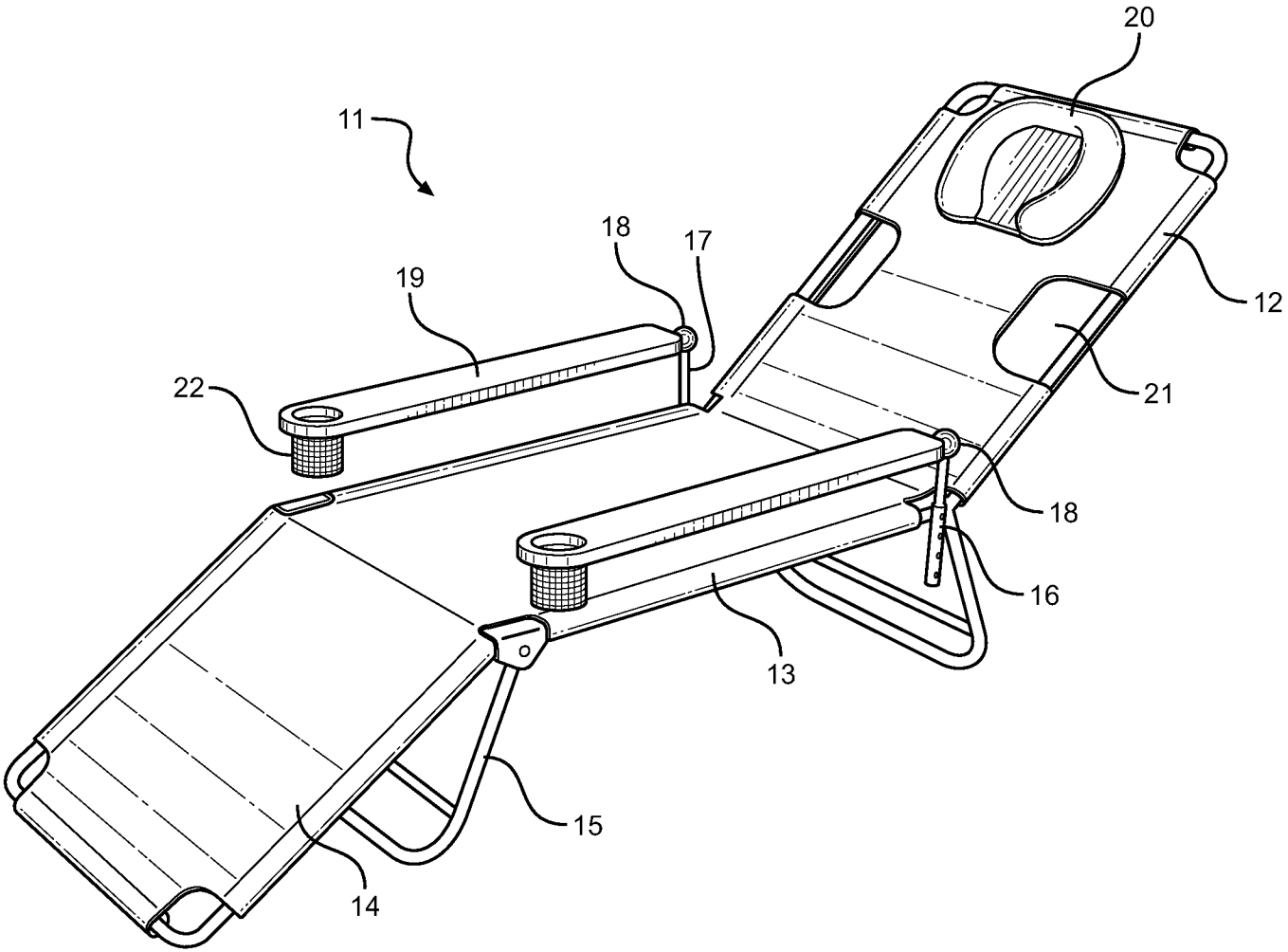
FIG. 1 shows a perspective view of the preferred embodiment of the invention.

Reference is made herein to the attached drawings. Like reference numerals are used throughout the drawings to depict like or similar elements of the lounge chair. For the purposes of presenting a brief and clear description of the present invention, the preferred embodiment will be discussed as used by a sunbather for lying outside in the sun. The figures are intended for representative purposes only and should not be considered to be limiting in any respect.

Referring now to FIG. 1, there is shown a perspective view of the preferred embodiment of the invention. The lounge chair 11 has an upper section 12, a middle section 13, and a lower section 14. The upper section is connected at one end to the middle section and is connected to the middle section pivotally. In this way the upper section can be raised or lowered so as to accommodate a user in a prone, reclined, or seated position. The lower end 14 is also connected pivotally to the middle section, at the end of the middle section opposite the connection to the upper section, such that the lower section can be raised or lowered so as to accommodate a user in a seated, reclined, or prone position. The middle section is supported above the ground by one or more legs 15. The lounge chair 11 further comprises a first support member 16 positioned on the middle section and a second support member 17 positioned on the opposite side of the middle section. Each support member has an armrest joint 18 on its upper end. Each armrest joint is connected to a first and second armrest 19 such that the armrests can be rotated about the joint and can be oriented in a variety of positions. The armrests can be adjusted by the user while sitting or lying in the lounge chair, and can be adjusted by hand. The armrests are capable of moving independently of one another. The lounge chair 11 in the embodiment shown further comprises a head cushion 20 on the upper section, and cupholders 22 positioned in the armrests.

Figure 2:
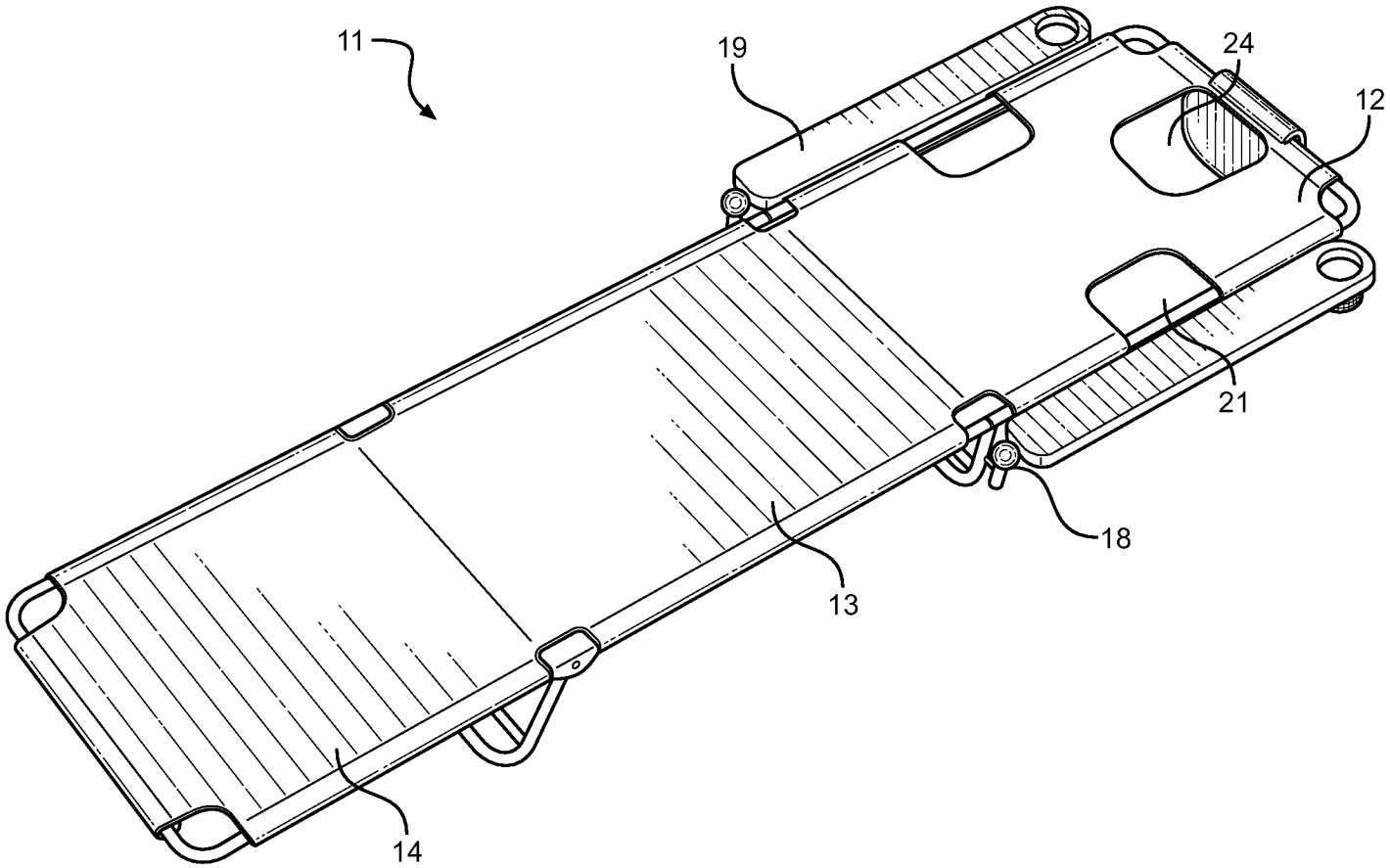
FIG. 2 shows a perspective view of an embodiment of the invention in a flat configuration.

Referring now to FIG. 2, there is shown a perspective view of an embodiment of the invention in a flat configuration. The lounge chair 11 comprises an upper section 12, a middle section 13, and a lower section 14. Here, the upper and lower sections have been adjusted so as to be substantially parallel to the ground. In this way, the upper, middle, and lower sections are substantially planar, enabling a user to lie in a prone position. In the configuration shown, the armrests 19 have been rotated about the armrest joints 18 so that the armrests are adjacent to the upper section of the lounge chair. Further, the armrests have been lowered so as to be approximately planar with the surface of the lounge chair. Thus, by lowering the armrests and rotating them to be adjacent to the upper section of the chair, a user may lie face down in a prone position and rest their arms on the armrests. If the armrests were not capable of being lowered, the armrests would be raised above the surface of the lounge chair, and a user lying face down would not be able to rest their arms on the armrests.

The embodiment of the invention shown in FIG. 2 further comprises a first and a second side aperture 21 adapted for a user lying face down to place their arms through, providing the user with more options for positioning their body. Further, the embodiment shows a face aperture 24 on the upper section of the lounge chair over which a user may place their face. By including an aperture through which the user may place their face, the user may view materials positioned underneath the upper section of the lounge chair such as reading materials.

Figure 3:
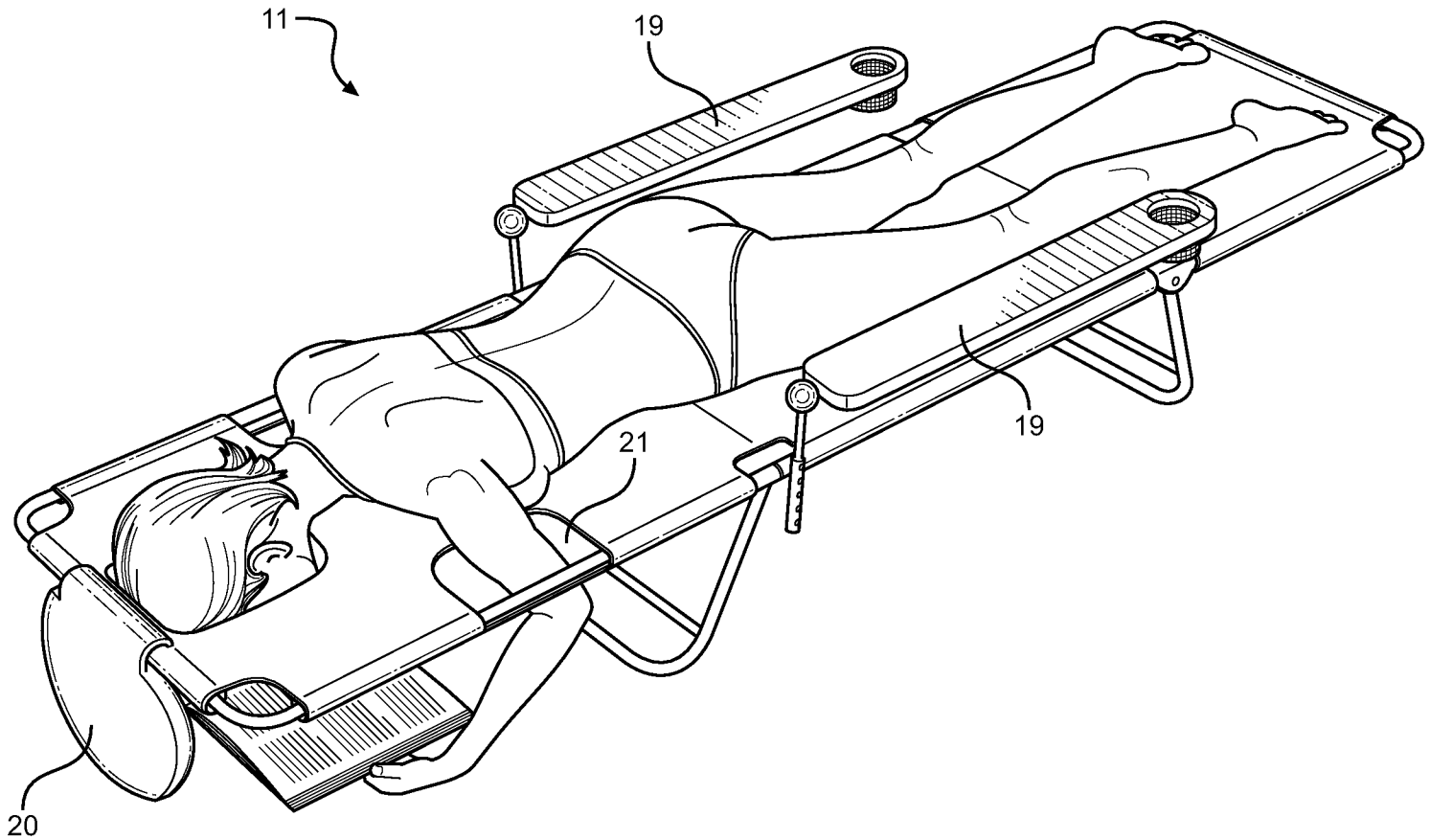
FIG. 3 shows a perspective view of the lounge chair in use.

Referring now to FIG. 3, there is shown a perspective view of the lounge chair in use. The lounge chair 11 is arranged in a flat configuration such that a user can lie face down in a prone position as shown. The armrests 19 are positioned such that they are adjacent to the middle section of the lounge chair. In this way, the armrests are positioned so as to not cast a shadow on the user's arms as may be the case if the armrests were configured so as to be adjacent to the upper segment of the lounge chair. The user's arms are shown as extending through the first and second side apertures 21 so as to allow the user to hold and manipulate objects below the upper section of the lounge chair. Further, the user's face is positioned over an aperture that is sized such that the user's head can be supported by the upper section of the lounge chair adjacent to the aperture. In this way, the user can view materials positioned beneath the upper section of the chair. Lastly, the head cushion 20 may be connected to the upper section of the chair and can be selectively positioned so as to cover the face aperture or to expose said face aperture.

Figure 4:
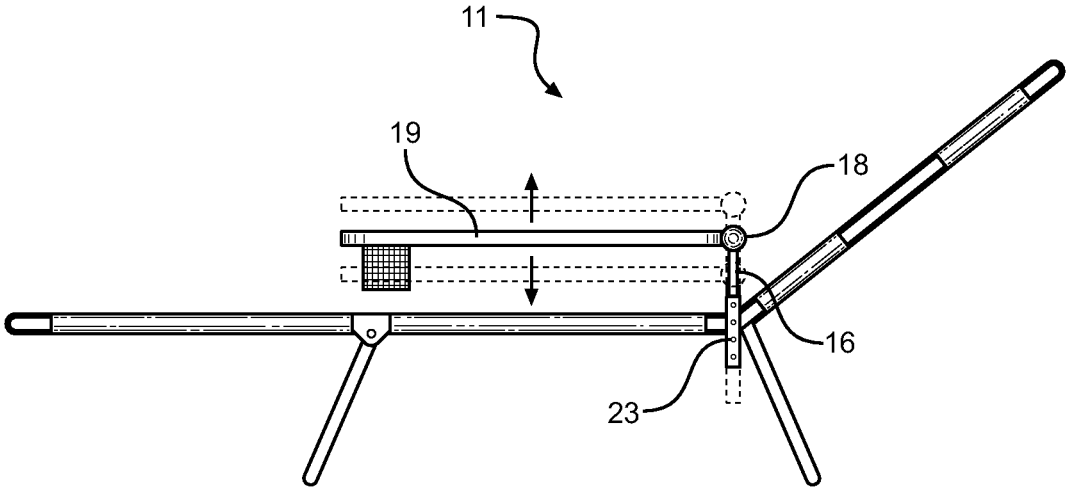
FIG. 4 shows a side view of an embodiment of the invention demonstrating the adjustable height of the armrests.

Referring now to FIG. 4, there is shown a side view of an embodiment of the invention demonstrating the adjustable height of the armrests. The armrest 19 is pivotally connected to an armrest joint 18 positioned on the upper end of a support member 16. The support members are connected to the middle section of the chair, preferably on the portion of the middle section closest to the upper section of the chair. The support members have a means for adjusting the height of the armrests. In the embodiment shown, the armrests are adjustable using a pin and hole arrangement on the lower portion of the support members. The support members have series of vertically arranged holes 23. A pin member is capable of engaging whichever hole the user desires, so as to allow the user to adjust the height of the armrests by engaging the pin with a different hole on the support member.

Figure 5:
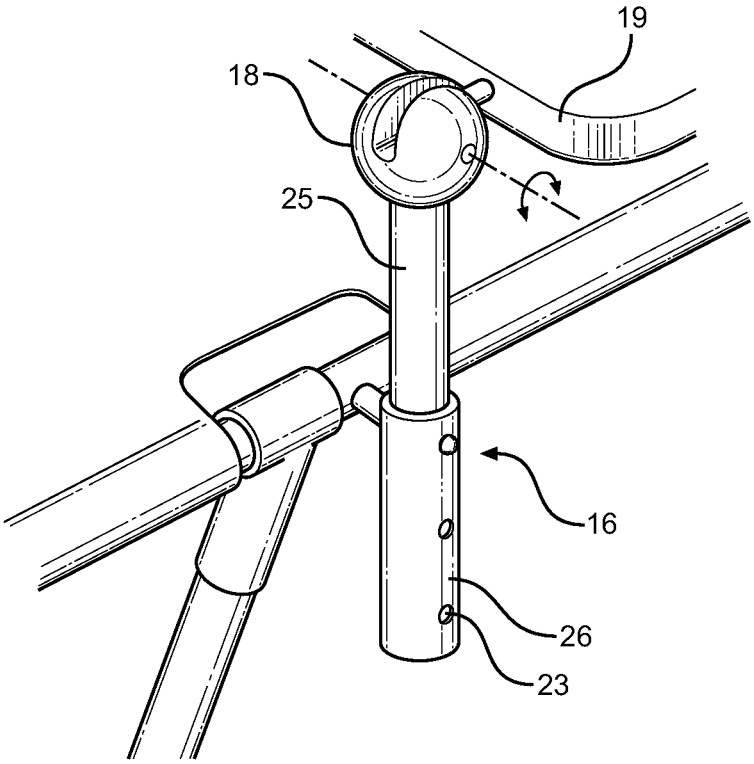
FIG. 5 shows a close-up view of the armrest joint on the lounge chair.

Referring now to FIG. 5, there is shown a close-up view of the armrest joint of the preferred embodiment of the lounge chair. The armrest 19 is connected pivotally to a support member 16 via an armrest joint 18. The armrest joint allows the armrest to rotate in a vertical plane, upward from the lounge chair. The support member 16 comprises an inner portion 25 and an outer portion 26. The inner portion is positioned inside of the outer portion and is capable of sliding upward and downward therein. Both the inner portion and the outer portion have a series of vertically arranged holes 23. The user can adjust the height of the inner portion of the support member, and once a desired height is achieved, the user can engage the pin to lock the inner portion and outer portion in place. The inner portion is capable of rotating within said outer portion such that the armrest can be rotated in a horizontal plane by rotating the inner portion of the support member.

Additional embodiments of the invention include different types of armrest joints. In one embodiment the armrest joint is a revolute joint which allows the armrest to rotate in a vertical plane, upward from the chair. The support member further comprises an inner and outer portion wherein the inner portion is positioned within the outer portion and is rotatable therein. The revolute joint is positioned on the inner portion of the support member. In this way, rotation of the inner portion allows the armrest to rotate in a horizontal plane.

In another embodiment of the invention, the armrest joint is a spherical joint. The spherical joint allows the arm to rotate in a greater range of motion than the revolute joint, and allows motion in a vertical plane. In this embodiment the support member further comprises an inner portion positioned within an outer portion. The spherical joint is positioned on the inner portion of the support member. The armrest can then rotate in a horizontal plane by rotating the inner portion of the support member within the outer portion.

Figure 6:
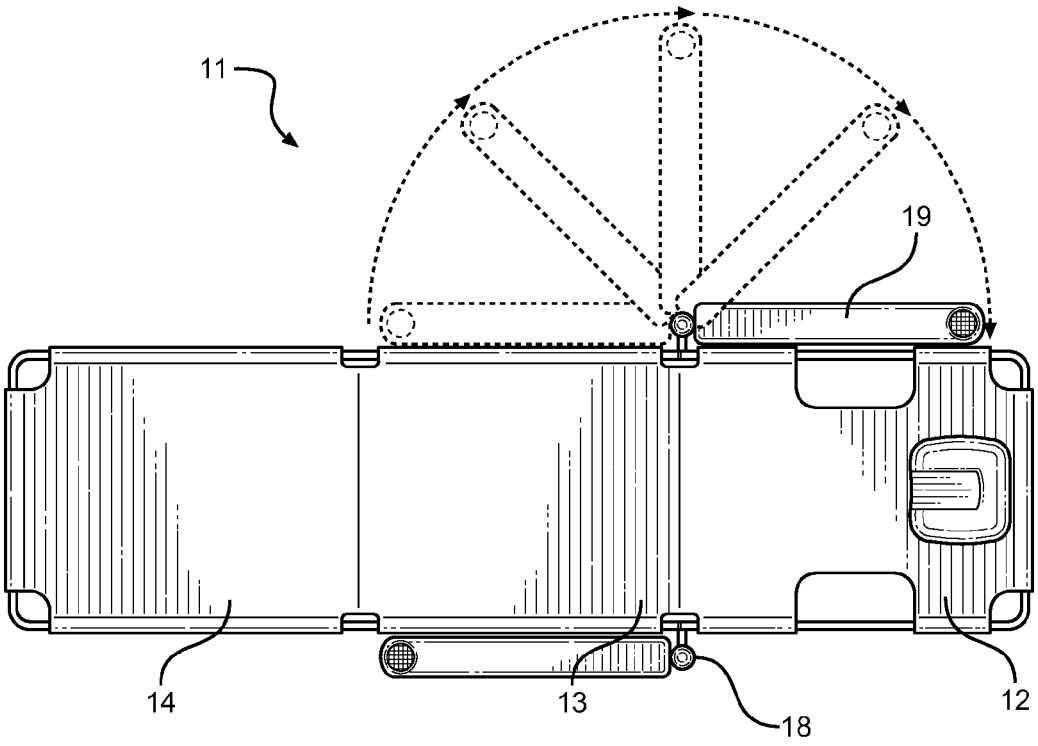
FIG. 6 shows a top view of the preferred embodiment of the invention demonstrating the movement of the armrests in a horizontal plane.

Referring now to FIG. 6, there is shown a top view of the preferred embodiment of the invention demonstrating the movement of the armrests in a horizontal plane. The lounge chair 11 is again shown as having an upper section 12, a middle section 13, and a lower section 14. The armrests 19 rotate about armrest joints 18. The armrests can rotate 180 degrees in a horizontal plane as shown. Thus, the armrests can be positioned adjacent to the middle section of the lounge chair, for use when the user is in a seated position, or the armrests may be positioned adjacent to the upper section of the lounge chair so as to provide armrests for a using lying face down. The armrest joints also allow the armrests to rotate 180 degrees in a vertical plane. In addition to moving in a horizontal and vertical plane, the armrest joints allow the armrests to move in a variety of other angles.

Traditional lounge chairs have adjustable back and leg rests, but have fixed arm rests. The inability to move or adjust the armrests of a lounge chair can be inconvenient to a user. The fixed armrests may cast shadows on the user's body, and the armrests are not capable of being used by a sunbather who is lying in a prone position. Lounge chair devices in the prior art include pivoting armrests, but do not disclose armrests that are also adjustable in height. Further, some devices in the prior art disclose armrests that are connected together or that move in unison. Such arrangements may also be inconvenient to the user, and the connection between the armrests tends to limit the movability of the armrests.

The present invention discloses a lounge chair having adjustable armrests. The lounge chair has an upper section, a middle section, and a lower section, wherein the upper and lower sections are adjustable. In this way, the lounge chair can be reconfigured into seated, reclined, or prone positions. The lounge chair further comprises support members attached on opposite sides of the middle section. The support members have joints at their upper ends, and one armrest is attached to each joint. The joint allows the armrests to be oriented in a variety of positions as desired by the user. Further, the support members have a means for raising or lowering the armrests so as to provide the user with more options for positioning the armrests and making beneficial use thereof.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable lounge chair, comprising:

an upper section, a middle section, a lower section, one or more legs, a first support member and a second support member, and a first armrest and a second armrest;

wherein said upper section is pivotally connected to said middle section, and said lower section is pivotally connected to said middle section;

wherein said one or more legs are connected to said middle section so as to support said middle section in an elevated position;

wherein said first support member and said second support member each have an upper end and a lower end;

wherein said first support member is connected to a first side of said middle section, and said second support member is connected opposite of said first support member on a second side of said middle section; and wherein said first armrest and said second armrest are rotatably connected to said first support member and said second support member via a first armrest joint and a second armrest joint, respectively;

said first armrest joint and said second armrest joint being adapted to allow rotation of said first armrest and said second armrest in a horizontal plane and vertical plane;

wherein said first support member and said second support member further comprise a sliding connection with said first armrest and said second armrest for adjusting the height of said first armrest and said second armrest;

said first armrest joint and said second armrest joint each further comprises a revolute joint;

wherein said first support member and said second support member each comprises an inner portion and an outer portion;

said inner portion being pivotally supported by said outer portion and wherein said outer portion is attached to said middle section;

said inner portion being slidably positionable within said outer portion.

2. The lounge chair of claim 1, wherein said upper section further comprises a first side aperture and a second side aperture adapted to allow a user to place their arms therethrough.

3. The lounge chair of claim 1, wherein said upper section further comprises a face aperture adapted to allow users to place their face in said face aperture.

4. The lounge chair of claim 1, wherein:

said upper section further comprises a face aperture adapted to allow users to place their face in said face aperture;

said upper section further comprises a head cushion rotatably connected to said upper section and operably deployable over said face aperture.

5. The lounge chair of claim 1, wherein said first armrest and said second armrest further comprise one or more cupholders.

6. An adjustable lounge chair, comprising:

an upper section, a middle section, a lower section, one or more legs, a first support member and a second support member, and a first armrest and a second armrest;

wherein said upper section is pivotally connected to said middle section, and said lower section is pivotally connected to said middle section;

wherein said one or more legs are connected to said middle section so as to support said middle section in an elevated position;

wherein said first support member and said second support member each have an upper end and a lower end;

wherein said first support member is connected to a first side of said middle section, and said second support member is connected opposite of said first support member on a second side of said middle section; and wherein said first armrest and said second armrest are rotatably connected to said first support member and said second support member via a first armrest joint and a second armrest joint, respectively;

said first armrest joint and said second armrest joint being adapted to allow rotation of said first armrest and said second armrest in a horizontal plane and vertical plane;

wherein said first support member and said second support member further comprise a sliding connection with said first armrest and said second armrest for adjusting the height of said first armrest and said second armrest;

said first armrest joint and said second armrest joint each further comprises a spherical joint; and wherein said first support member and said second support member each comprise an inner portion and an outer portion;

said inner portion being pivotally supported by said outer portion and wherein said outer portion is attached to said middle section;

said inner portion being slidably positionable within said outer portion.

7. The lounge chair of claim 6, wherein said upper section further comprises a first side aperture and a second side aperture adapted to allow a user to place their arms therethrough.

8. The lounge chair of claim 6, wherein said upper section further comprises a face aperture adapted to allow users to place their face in said face aperture.

9. The lounge chair of claim 6, wherein:

said upper section further comprises a face aperture adapted to allow users to place their face in said face aperture;

said upper section further comprises a head cushion rotatably connected to said upper section and operably deployable over said face aperture.

10. The lounge chair of claim 6, wherein said first armrest and said second armrest further comprise one or more cupholders.

* * * * *